US010995984B2

(12) United States Patent
Baxter et al.

(10) Patent No.: US 10,995,984 B2
(45) Date of Patent: May 4, 2021

(54) METHOD FOR SEPARATING COMPONENTS OF A GAS

(71) Applicant: Sustainable Energy Solutions, Inc., Provo, UT (US)

(72) Inventors: Larry Baxter, Orem, UT (US); Chris Hoeger, Provo, UT (US); Jacom Chamberlain, Provo, UT (US); Kyler Stitt, Lindon, UT (US)

(73) Assignee: Sustainable Energy Solutions, Inc., Ball Ground, GA (US)

( * ) Notice: Subject to any disclaimer, the term of this patent is extended or adjusted under 35 U.S.C. 154(b) by 178 days.

(21) Appl. No.: 16/035,560

(22) Filed: Jul. 13, 2018

(65) Prior Publication Data

US 2020/0018546 A1 Jan. 16, 2020

(51) Int. Cl.

| | |
|---|---|
| ***F25J 3/08*** | (2006.01) |
| ***F25J 3/06*** | (2006.01) |
| ***F25J 5/00*** | (2006.01) |

(52) U.S. Cl.

CPC ..... *F25J 3/08* (2013.01); *F25J 3/0635* (2013.01); *F25J 3/0665* (2013.01); *F25J 5/00* (2013.01); *F25J 2205/20* (2013.01); *F25J 2210/60* (2013.01); *F25J 2215/04* (2013.01); *F25J 2215/60* (2013.01); *F25J 2215/80* (2013.01); *F25J 2220/62* (2013.01); *F25J 2220/64* (2013.01); *F25J 2220/66* (2013.01); *F25J 2220/68* (2013.01)

(58) Field of Classification Search

CPC ..... F25J 3/02; F25J 3/0209; F25J 3/08; F25J 3/065; F25J 3/0266; F25J 2210/60; F25J 2270/08; B01D 5/0027; C07C 7/04; C07C 7/10

USPC ..... 62/625, 632

See application file for complete search history.

(56) References Cited

U.S. PATENT DOCUMENTS

| | | | | |
|---|---|---|---|---|
| 3,376,709 A * | 4/1968 | Dickey | C07C 7/14 | 62/637 |
| 4,563,202 A * | 1/1986 | Yao | F25J 3/0209 | 2/17 |
| 8,764,885 B2 * | 7/2014 | Baxter | B01D 53/002 | 95/226 |
| 2019/0128603 A1 * | 5/2019 | Baxter | B01D 7/02 | |

* cited by examiner

*Primary Examiner* — Frantz F Jules
*Assistant Examiner* — Erik Mendoza-Wilkenfel
(74) *Attorney, Agent, or Firm* — Cook Alex Ltd.; R. Blake Johnston

(57) ABSTRACT

A method is disclosed for separating components of a gas. A feed gas stream is cooled in the first vessel. The feed gas stream comprises methane, carbon dioxide, and a secondary component. A first portion of the secondary component condenses, desublimates, or a combination thereof to form a primary stream, resulting in a first depleted gas stream. The first depleted gas stream is cooled in a condensing exchanger such that a first portion of the methane condenses as a first liquid methane stream, resulting in a second depleted gas stream. The second depleted gas stream is cooled in the second vessel such that a first portion of the carbon dioxide desublimates to form a solid product stream, resulting in a third depleted gas stream.

18 Claims, 5 Drawing Sheets

METHOD FOR SEPARATING COMPONENTS OF A GAS

GOVERNMENT INTEREST STATEMENT

This invention was made with government support under DE-FE0028697 awarded by the Department of Energy. The government has certain rights in the invention.

TECHNICAL FIELD

The devices and processes described herein relate generally to separation of gases.

BACKGROUND

Separating gases from other gases is a challenge in any industry. In some instances, such as in natural gas production, the gases to be removed can not only lower the value of the natural gas but can make it unusable unless purified. Many processes exist for stripping contaminants out of natural gas, but they suffer from a variety of downsides. Some are energy inefficient. Some have limited extraction capacity. Some are not feasible in remote locations, where natural gas is typically located. Energy efficient and cost-effective methods for purifying natural gas streams are needed.

SUMMARY

In one aspect, the disclosure provides a method for separating components of a gas. A feed gas stream is cooled in the first vessel. The feed gas stream comprises methane, carbon dioxide, and a secondary component. A first portion of the secondary component condenses, desublimates, or a combination thereof to form a primary stream, resulting in a first depleted gas stream. The first depleted gas stream is cooled in a condensing exchanger such that a first portion of the methane condenses as a first liquid methane stream, resulting in a second depleted gas stream. The second depleted gas stream is cooled in the second vessel such that a first portion of the carbon dioxide desublimates to form a solid product stream, resulting in a third depleted gas stream.

Further aspects and embodiments are provided in the foregoing drawings, detailed description and claims.

BRIEF DESCRIPTION OF THE DRAWINGS

The following drawings are provided to illustrate certain embodiments described herein. The drawings are merely illustrative and are not intended to limit the scope of claimed inventions and are not intended to show every potential feature or embodiment of the claimed inventions. The drawings are not necessarily drawn to scale; in some instances, certain elements of the drawing may be enlarged with respect to other elements of the drawing for purposes of illustration.

DETAILED DESCRIPTION

Figure 1:
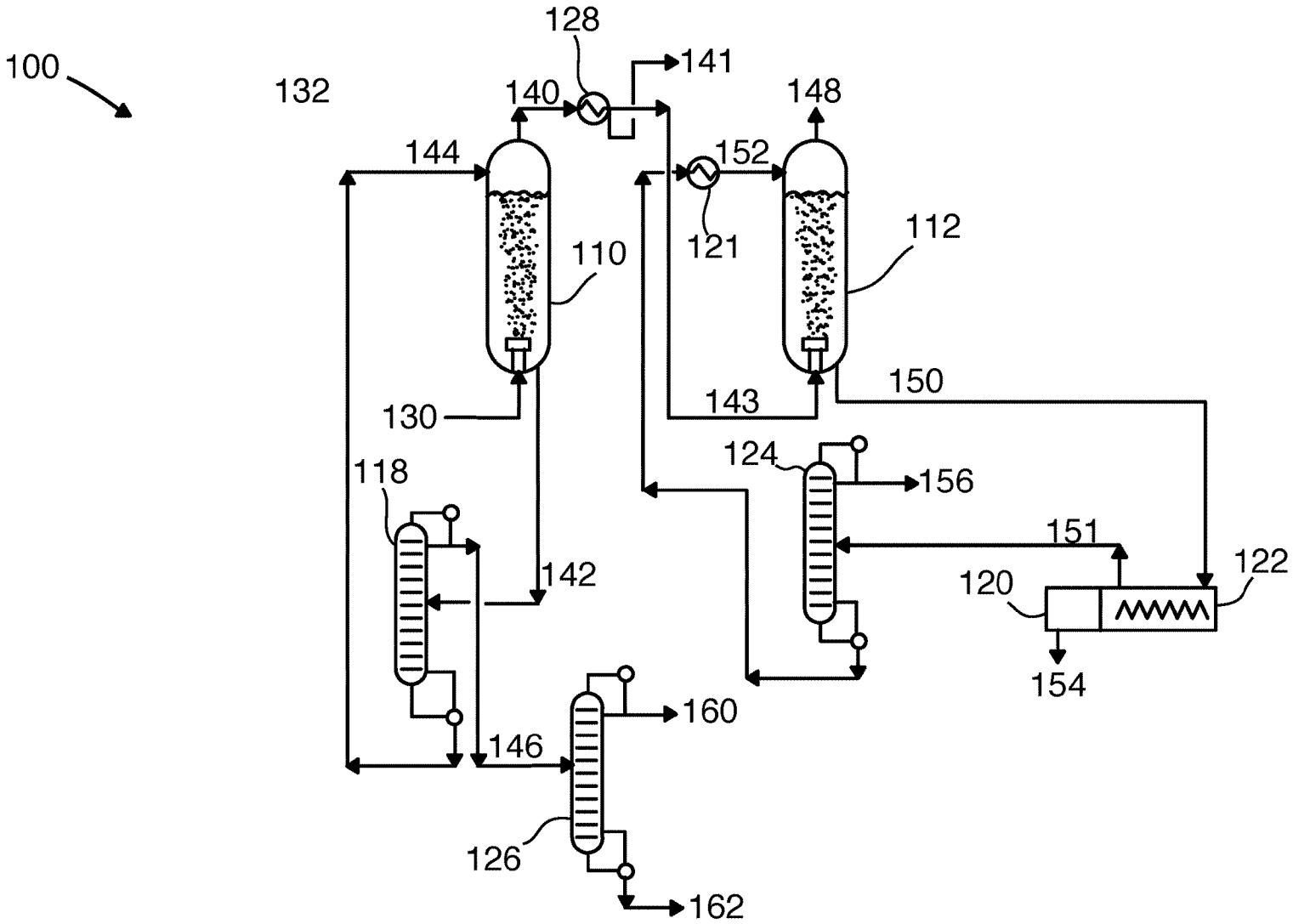
FIG. 1 is a flow diagram showing a process for separating components of a gas.

The following description recites various aspects and embodiments of the inventions disclosed herein. No particular embodiment is intended to define the scope of the invention. Rather, the embodiments provide non-limiting examples of various compositions, and methods that are included within the scope of the claimed inventions. The description is to be read from the perspective of one of ordinary skill in the art. Therefore, information that is well known to the ordinarily skilled artisan is not necessarily included.

Definitions

The following terms and phrases have the meanings indicated below, unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa, unless expressly indicated to the contrary.

As used herein, the singular forms "a," "an," and "the" include plural referents unless the context clearly dictates otherwise. For example, reference to "a substituent" encompasses a single substituent as well as two or more substituents, and the like.

As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

As used herein, "natural gas" is meant to refer to a methane containing gas stream. Natural gas, as harvested in the field, contains at least water and carbon dioxide. In many instances, natural gas may also contain NGLs, nitrogen, argon, hydrogen sulfide, and hydrogen.

As used herein, the term "NGLs" is meant to refer to compounds selected from the group consisting of ethane, propane, butane, isobutane, pentane, natural gasoline, cyclic hydrocarbons, aromatic hydrocarbons and combinations thereof.

As used herein, "cryogenic" is intended to refer to temperatures below about −58° F. (−50° C.).

As used herein, "desublimate" refers to the process of a gas changing to a solid state directly, without passing through the liquid phase. This is to distinguish it from the term, "condense," which is used herein to refer to the process of a gas changing to a liquid state directly.

As used herein, "liquid-liquid" separators refer to a device that separates one liquid compound from another liquid compound. This includes decanters, centrifuges, settling tanks, thickeners, clarifiers, distillation columns, flash vessels, or similar devices used in the art.

Purifying natural gas can be complex and energy inefficient. The methods, devices, and systems disclosed herein overcome these limitations, as well as providing other benefits that will be apparent to those of skill in the art. A natural gas stream is cooled in a first vessel. This first vessel has the necessary temperature gradients and pressure to condense, desublimate, or both condense and desublimate a portion of secondary components as a liquid, solid, or slurry, respectively. The secondary components include primarily water and NGLs but may also include other typical natural gas contaminants. The resultant first depleted gas stream is then cooled in a condensing exchanger. A portion of the methane condenses as a liquid methane stream, resulting in a second depleted gas stream. The liquid methane stream is withdrawn or passed on with the second depleted gas stream. The second depleted gas stream is cooled in the second vessel. The second vessel has the necessary temperature gradients and pressure to condense a portion of the carbon dioxide as a solid. A second portion of the methane may be condensed out, as well. The combination of these two exchangers produces benefits far beyond that of each process individually, as detailed below.

The methods, devices, and systems disclosed herein have advantages compared to current technologies. These may include:

1. Eliminating the chemical hazards and costs associated with amine absorption technologies;
2. Combining natural gas sweetening ($CO_2$ removal), drying ($H_2O$ removal), NGLs recovery, and trace gas mitigation ($H_2S$ and $N_2$ removal) into a single process step;
3. Treating natural gas without reducing pressure, thereby decreasing repressurization equipment requirements and costs while also decreasing equipment size;
4. Improving NGLs recovery;
5. Enabling treatment of high-$CO_2$ natural gas streams;
6. Reducing treatment facility size, health and environmental hazards, and capital costs; and,
7. Reducing process energy consumption and cost.

The methods, devices, and systems disclosed may treat natural gas at typical plant delivery pressures of 60-100 bar. The first step of the process simultaneously removes moisture and a portion of the NGLs, which will generally be immiscible and therefore easily separated. This may occur in a single vessel, either as an indirect-contact exchanger or a direct-contact exchanger (configured as a counter-current spray column, packed column, staged column, or other vessels typically used for direct-contact exchange) and prepares the gas for the second stage. The second step removes a portion of the methane as a liquid stream, which can be carried on to the second vessel or withdrawn. The final stage acts as both a heat exchanger and gas treatment stage, removing a portion of the carbon dioxide and may also remove a portion of the methane. The products from the final stage may be rewarmed to near the initial operating temperature by helping to cool upstream flows.

The two stages operate in synergy in that each stage may both remove impurities from the natural gas and may cool the natural gas stream in preparation for introduction to the downstream process. The synergy of the stages includes both removing the impurities—which otherwise might represent operational difficulties for the downstream process—and cooling the stream. The synergy may extend to the warming portion of the process, in which the cold product streams from each stage contribute to cooling the incoming flows as they warm back toward operating temperatures.

FIG. 1 is a process flow diagram 100 for separating components of a gas that may be used in the methods and systems disclosed herein. A natural gas feed stream 130 is bubbled into a first vessel 110, contacting a first contact liquid stream 144 descending through first vessel 110. First vessel 110 is a bubbler-style direct-contact exchanger. The natural gas feed stream 130 consists of methane, carbon dioxide, and secondary components. The secondary components in this example consist of water and NGLs. In some embodiments, the secondary components also include inert gases, such as argon and nitrogen. The NGLs may consist of ethane, propane, butane, isobutane, pentane, natural gasoline, cyclic hydrocarbons, aromatic hydrocarbons, or a combination thereof. The natural gas feed stream 130 is cooled as it bubbles up through the first contact liquid stream 144 such that a first portion of the secondary components condense and desublimate to form a mix of solid and liquid secondary components while a first portion of the carbon dioxide condenses as liquid carbon dioxide. The liquid carbon dioxide is present in varying quantities, depending on how cold the first contact liquid stream 144 is made. The mixed solid and liquid secondary components and the liquid carbon dioxide mix with the first contact liquid, leaving the first vessel 110 as first product stream 142. The natural gas feed stream 130 leaves the first vessel 110 as a first depleted gas stream 140.

The first depleted gas stream 140 is cooled passing through a chiller 128, condensing a first portion of the methane to form a liquid methane and a second depleted gas. A portion of the liquid methane is drained from the chiller 128 as a liquid methane product stream 141. The second depleted gas and any remaining liquid methane are passed on as second feed stream 143. In some embodiments, a portion of the carbon dioxide present in the first depleted gas stream 140 is condensed into the liquid methane product stream 141.

The second feed stream 143 is bubbled into a second vessel 112, contacting a second contact liquid stream 152 descending through second vessel 112. Second vessel 112 is a bubbler-style direct-contact exchanger. The second feed stream 143 is cooled as it bubbles up through the second contact liquid stream 152 such that a second portion of the methane condenses to form liquid methane, a second portion of the carbon dioxide desublimates to form solid carbon dioxide, and a second portion of the secondary components desublimate to form solid secondary components. The mix of the liquid methane, the solid carbon dioxide, and the solid secondary components leaves the second vessel 112 with the second contact liquid as product slurry stream 150. The remaining gases leave as second depleted gas stream 148. The second depleted gas stream 148 consists of any uncondensed and undesublimated components and any inert gases that were present in the original natural gas feed stream 130.

The first product stream 142 is passed into a first distillation column 118, which separates the first product stream 142 into the first contact liquid stream 144 and a first overhead stream 146, containing the carbon dioxide and the mix of secondary components stripped from the natural gas feed stream 130 in the first vessel 110. The first overhead stream 146 is passed into a second distillation column 126, which separates the carbon dioxide out as the second overhead stream 160 and the water with secondary components out as second bottoms stream 162.

The product slurry stream 150 is passed through a screw filtering device 122 where the warm second contact liquid and the liquid methane are filtered out of the slurry product stream 150 and leave as mixed liquid stream 151. The mixed liquid stream 151 is passed into a third distillation column 124, with the warm second contact liquid passed out as a third bottoms stream 158 and the methane passed out as a third overhead stream 156. The third bottoms stream 158 is cooled across second-stage chiller 121 to produce the second contact liquid stream 152. The solids from the slurry product stream 150 pass through a melter 120, which melts the carbon dioxide and the second portion of the secondary components to form a liquid product stream 154.

Figure 2:
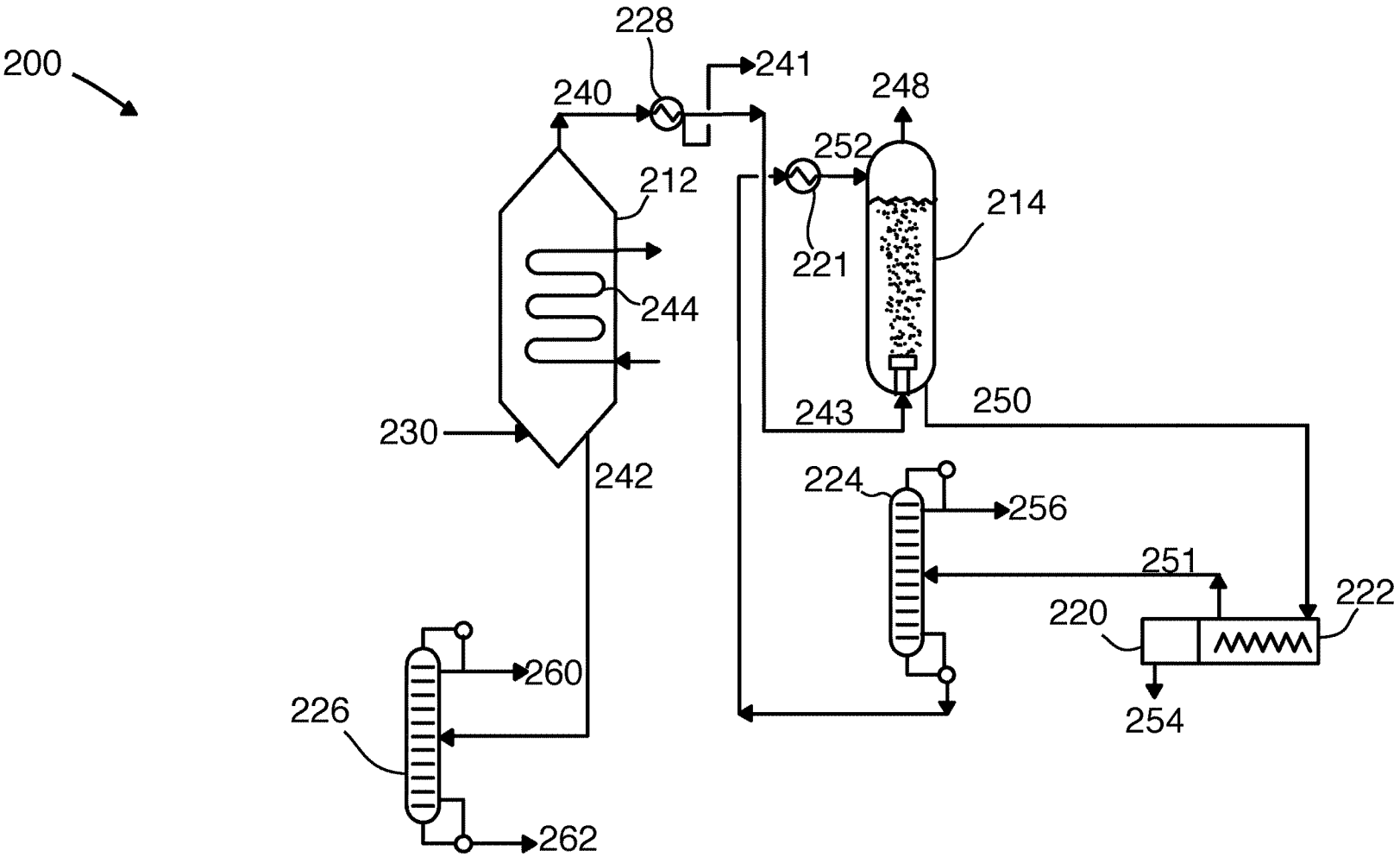
FIG. 2 is a flow diagram showing a process for separating components of a gas.

FIG. 2 is a process flow diagram 200 for separating components of a gas that may be used in the methods and systems disclosed herein. A natural gas feed stream 230 is passed into a first vessel 210. First vessel 210 is an indirect-contact heat exchanger. The natural gas feed stream 230 consists of methane, carbon dioxide, and secondary components. The secondary components in this example consist of water, NGLs, nitrogen, and argon. The NGLs in this example consist of ethane and propane. The natural gas feed stream 230 is cooled as it passes across cooling coils 244 such that a portion of the secondary components condense to form liquid secondary components. The liquid secondary components leave the first vessel 210 as first product stream 242. The natural gas feed stream 230 leaves the first vessel 210 as a first depleted gas stream 240.

The first depleted gas stream 240 is cooled passing through a chiller 228, condensing a first portion of the methane to form a liquid methane and a second depleted gas. A portion of the liquid methane is drained from the chiller 228 as a liquid methane product stream 241. The second depleted gas and any remaining liquid methane are passed on as second feed stream 243.

The second feed stream 243 is bubbled into a second vessel 212, contacting a contact liquid stream 252 descending through second vessel 212. Second vessel 212 is a bubbler-style direct-contact exchanger. The second feed stream 243 is cooled as it bubbles up through the contact liquid stream 252 such that a portion of the methane condenses to form liquid methane and a second portion of the carbon dioxide desublimates to form solid carbon dioxide. The mix of the liquid methane and the solid carbon dioxide leaves the second vessel 212 with the contact liquid as product slurry stream 250. The remaining gases leave as second depleted gas stream 248. The second depleted gas stream 248 consists of any uncondensed and undesublimated components and the inert gases that were present in the original natural gas feed stream 130.

The first product stream 242 is passed into a first distillation column 218, which separates the first product stream 242 into a first overhead stream 260 and a first bottoms stream 262. The first overhead stream 260 consists of primarily the non-aqueous secondary components, while the first bottoms stream 262 consists of primarily the water.

The product slurry stream 250 is passed through a screw filtering device 222 where the warm second contact liquid and the liquid methane are filtered out of the slurry product stream 250 and leave as mixed liquid stream 251. The mixed liquid stream 251 is passed into a second distillation column 224, with the warm contact liquid passed out as a second bottoms stream 258 and the methane passed out as a second overhead stream 256. The second bottoms stream 258 is cooled across second-stage chiller 221 to produce the contact liquid stream 252. The solids from the slurry product stream 250 pass through a melter 220, which melts the carbon dioxide a liquid carbon dioxide stream 254.

Figure 3:
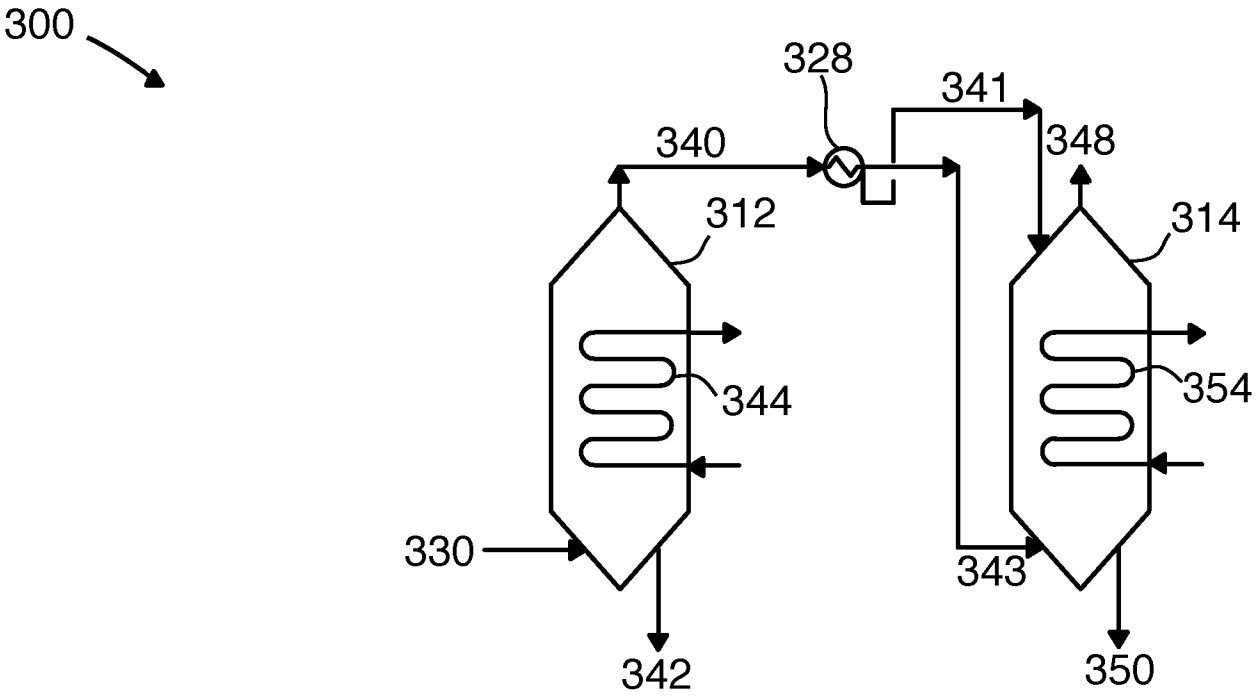
FIG. 3 is a flow diagram showing a process for separating components of a gas.

FIG. 3 is a process flow diagram 300 for separating components of a gas that may be used in the methods and systems disclosed herein. A natural gas feed stream 330 is passed into a first vessel 310. First vessel 310 is an indirect-contact heat exchanger. The natural gas feed stream 330 consists of methane, carbon dioxide, and secondary components. The natural gas feed stream 330 is cooled as it passes across cooling coils 344 such that a portion of the secondary components condense to form liquid secondary components, which leave the first vessel 310 as first product stream 342. The natural gas feed stream 330 leaves the first vessel 310 as a first depleted gas stream 340.

The first depleted gas stream 340 is cooled passing through a chiller 328, condensing a first portion of the methane to form a liquid methane and a second depleted gas. A portion of the liquid methane is drained from the chiller 328 as a liquid methane product stream 341. The second depleted gas and any remaining liquid methane are passed on as second feed stream 343.

The liquid methane product stream 341 is passed into a second vessel 312 where the liquid methane product stream is indirectly cooled by contact with the cooling coils 354, resulting in a chilled methane stream in the second vessel 312. Second vessel 312 is an indirect-contact heat exchanger. The second feed stream 343 is bubbled into the second vessel 312. The second feed stream 343 is cooled by the chilled methane stream such that a portion of the carbon dioxide desublimates into the chilled methane stream, resulting in a product slurry stream 350. In some embodiments, a second portion of the methane condenses into the product slurry stream 350. Any uncondensed components of the feed gas stream 330 leave as second depleted gas stream 348.

Figure 4:
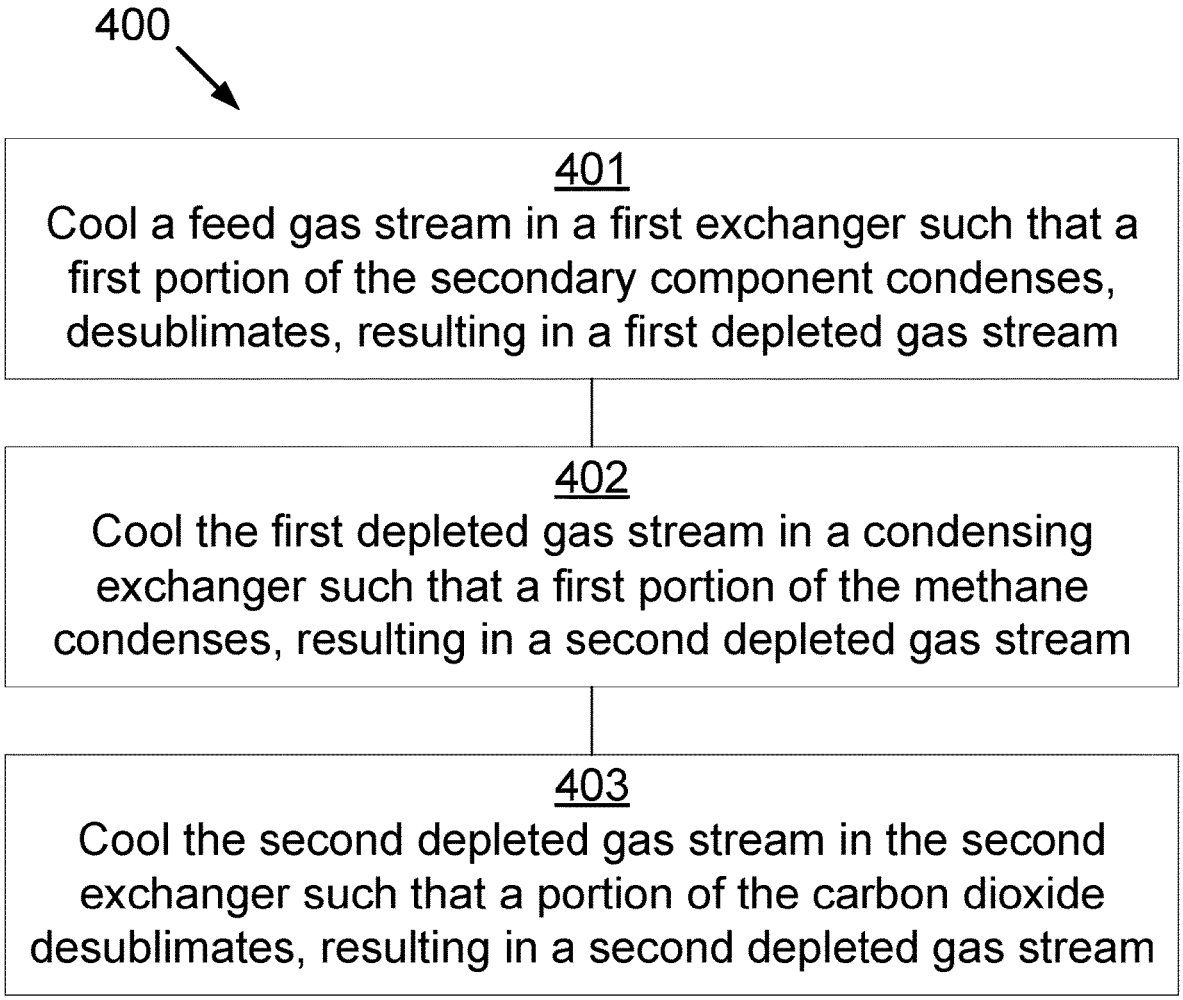
FIG. 4 is a block diagram depicting a method for separating components of a gas.

FIG. 4 is a method 400 for separating components of a gas that may be used in the devices, methods, and systems disclosed herein. A feed gas stream includes methane, carbon dioxide, and a secondary component. At 401, the feed gas stream is cooled in the first vessel such that a first portion of the secondary component condenses, desublimates, or a combination thereof to form a secondary stream, resulting in a first depleted gas stream. At 402, the first depleted gas stream is cooled in a condensing exchanger such that a first portion of the methane condenses as a first liquid methane stream, resulting in a second depleted gas stream. At 403, the second depleted gas stream is cooled in the second vessel such that a first portion of the carbon dioxide desublimates, producing a solid product stream and resulting in a third depleted gas stream.

Figure 5:
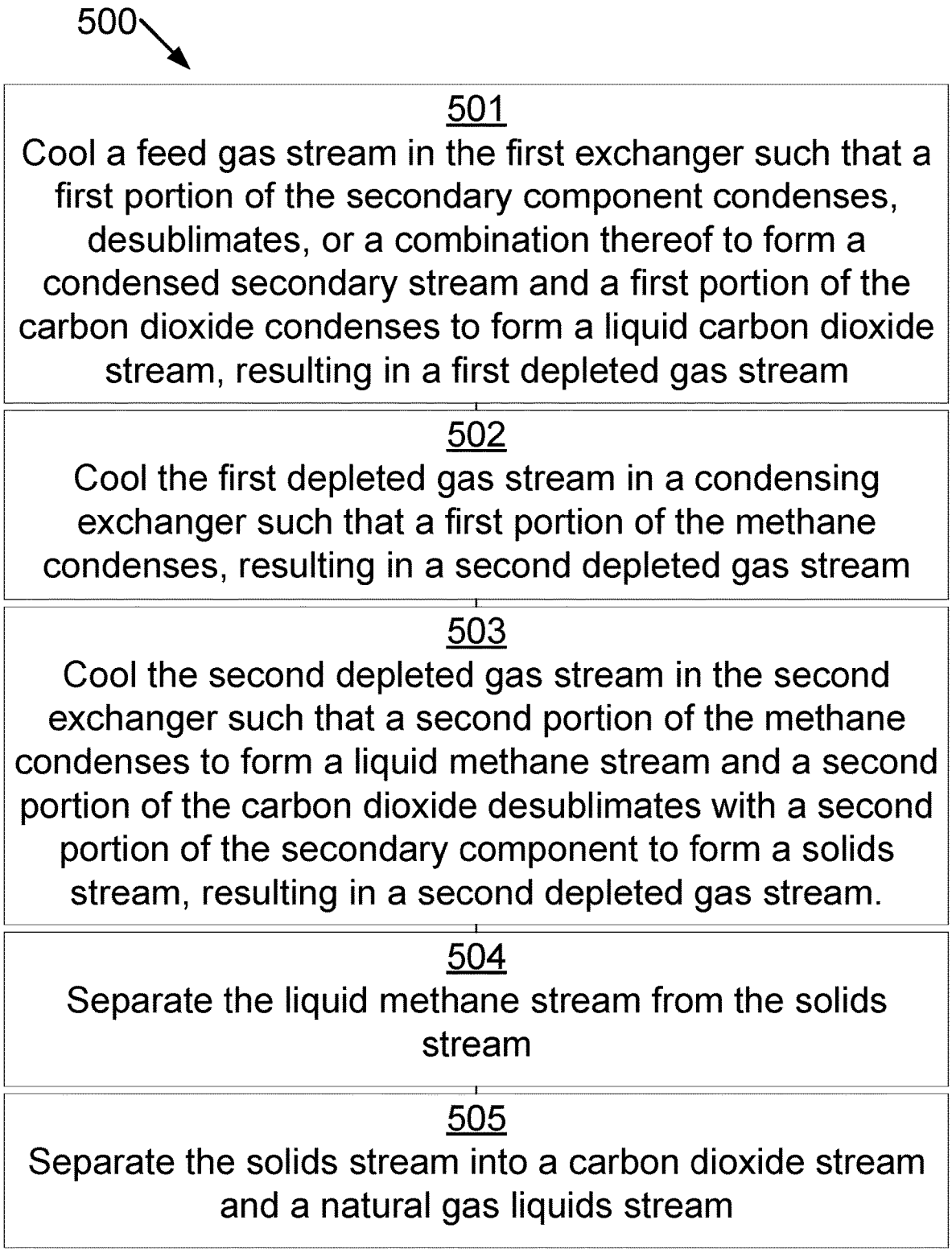
FIG. 5 is a block diagram depicting a method for separating components of a gas.

FIG. 5 is a method 500 for separating components of a gas that may be used in the devices, methods, and systems disclosed herein. A feed gas stream includes methane, carbon dioxide, and a secondary component. The secondary component includes water, NGLs. At 501, the feed gas stream is cooled in the first vessel such that a first portion of the secondary component condenses, desublimates, or a combination thereof to form a secondary stream and a first portion of the carbon dioxide condenses to form a liquid carbon dioxide stream, resulting in a first depleted gas stream. At 502, the first depleted gas stream is cooled in a condensing exchanger such that a first portion of the methane condenses as a first liquid methane stream, resulting in a second depleted gas stream. At 503, the second depleted gas stream is cooled in the second vessel such that a second portion of the methane condenses to form a liquid methane stream and a second portion of the carbon dioxide desublimates with a second portion of the secondary component to form a solids stream, resulting in a second depleted gas stream. At 504, the liquid methane stream is separated from the solids stream. At 505, the solids stream is separated into a carbon dioxide stream and a NGLs stream.

In some embodiments, the secondary component also consists of hydrogen sulfide, mercaptans, hydrogen, or a combination thereof.

In some embodiments, the second depleted gas stream contains substantially no methane. "Substantially no methane" may be less than 5 wt % methane, preferably less than 1 wt % methane, and most preferably less than 0.3 wt % methane.

In some embodiments, substantially all of the water is removed from the feed gas stream. In a preferred embodiment, "substantially all of the water" should leave no more than 1 ppm water in the second depleted gas stream. In a more preferred embodiment, "substantially all of the water" should leave no more than 100 ppb water in the second depleted gas stream. In an even more preferred embodiment, "substantially all of the water" should leave no more than 10 ppb water in the second depleted gas stream. In a most preferred embodiment, "substantially all of the water" should leave no more than 1 ppb water in the second depleted gas stream.

In one embodiment, substantially all of the NGLs are removed from the feed gas stream. In a preferred embodiment, "substantially all of the NGLs" should leave no more than 1 ppm NGLs in the second depleted gas stream. In a more preferred embodiment, "substantially all of the NGLs" should leave no more than 100 ppb NGLs in the second depleted gas stream. In an even more preferred embodiment, "substantially all of the NGLs" should leave no more than 10 ppb NGLs in the second depleted gas stream. In a most preferred embodiment, "substantially all of the NGLs" should leave no more than 1 ppb NGLs in the second depleted gas stream.

In one embodiment, substantially all of the carbon dioxide is removed from the feed gas stream. In a preferred embodiment, "substantially all of the carbon dioxide" should leave no more than 120,000 ppm carbon dioxide in the second depleted gas stream. In a more preferred embodiment, "substantially all of the carbon dioxide" should leave no more than 50,000 ppm carbon dioxide in the second depleted gas stream. In an even more preferred embodiment, "substantially all of the carbon dioxide" should leave no more than 1,000 ppm carbon dioxide in the depleted gas stream. In a most preferred embodiment, "substantially all of the carbon dioxide" should leave no more than 50 ppm carbon dioxide in the depleted gas stream.

In some embodiments, the first contact liquid stream, the second contact liquid stream, or both contact liquid streams may consist of a mixture of a solvent and an ionic compound. The solvent may consist of water, hydrocarbons, liquid ammonia, liquid carbon dioxide, cryogenic liquids, or a combination thereof. The ionic compound may consist of potassium carbonate, potassium formate, potassium acetate, calcium magnesium acetate, magnesium chloride, sodium chloride, lithium chloride, calcium chloride, or a combination thereof.

In some embodiments, the first contact liquid stream, the second contact liquid stream, or both contact liquid streams may consist of a mixture of a solvent and a soluble organic compound. The solvent may consist of water, hydrocarbons, liquid ammonia, liquid carbon dioxide, cryogenic liquids, or a combination thereof. The soluble organic compound may consist of glycerol, ammonia, propylene glycol, ethylene glycol, ethanol, methanol, or a combination thereof.

In some embodiments, the first contact liquid stream, the second contact liquid stream, or both contact liquid streams may consist of ethers, alcohols, hydrocarbons, liquid ammonia, liquid carbon dioxide, cryogenic liquids, or a combination thereof.

In some embodiments, the hydrocarbons consist of 1,1,3-trimethylcyclopentane, 1,4-pentadiene, 1,5-hexadiene, 1-butene, 1-methyl-1-ethylcyclopentane, 1-pentene, 2,3,3,3-tetrafluoropropene, 2,3-dimethyl-1-butene, 2-chloro-1,1,1,2-tetrafluoroethane, 2-methylpentane, 3-methyl-1,4-pentadiene, 3-methyl-1-butene, 3-methyl-1-pentene, 3-methylpentane, 4-methyl-1-hexene, 4-methyl-1-pentene, 4-methylcyclopentene, 4-methyl-trans-2-pentene, bromochlorodifluoromethane, bromodifluoromethane, bromotrifluoroethylene, chlorotrifluoroethylene, cis 2-hexene, cis-1,3-pentadiene, cis-2-hexene, cis-2-pentene, dichlorodifluoromethane, difluoromethyl ether, trifluoromethyl ether, dimethyl ether, ethyl fluoride, ethyl mercaptan, hexafluoropropylene, isobutane, isobutene, isobutyl mercaptan, isopentane, isoprene, methyl isopropyl ether, methylcyclohexane, methylcyclopentane, methylcyclopropane, n,n-diethylmethylamine, octafluoropropane, pentafluoroethyl trifluorovinyl ether, propane, sec-butyl mercaptan, trans-2-pentene, trifluoromethyl trifluorovinyl ether, vinyl chloride, bromotrifluoromethane, chlorodifluoromethane, dimethyl silane, ketene, methyl silane, perchloryl fluoride, propylene, vinyl fluoride, or a combination thereof.

The invention has been described with reference to various specific and preferred embodiments and techniques. Nevertheless, it understood that many variations and modifications may be made while remaining within the spirit and scope of the invention.

What is claimed is:

1. A method for separating components of a gas comprising:

cooling a feed gas stream in a first vessel, wherein the feed gas stream comprises methane, carbon dioxide, and a secondary component, such that a first portion of the secondary component condenses, desublimates, or a combination thereof to form a primary stream, resulting in a first depleted gas stream leaving the first vessel;

cooling the first depleted gas stream in a condensing exchanger such that a first portion of the methane condenses as a first liquid methane stream, resulting in a second depleted gas stream leaving the condensing exchanger;

cooling the second depleted gas stream in the second vessel such that a first portion of the carbon dioxide desublimates, producing a solid product stream and resulting in a third depleted gas stream leaving the second vessel; and wherein cooling the first depleted gas stream condenses a second portion of the carbon dioxide into the first liquid methane stream.

2. The method of claim 1, wherein cooling the second depleted gas stream condenses a second portion of the methane as a second liquid methane stream, the second liquid methane stream entraining the solid product stream, resulting in a methane slurry stream.

3. The method of claim 2, further comprising separating the methane slurry stream into a liquid methane stream and a solid carbon dioxide stream.

4. The method of claim 1, wherein cooling the second depleted gas stream desublimates a second portion of the secondary component into the liquid methane stream.

5. The method of claim 1, wherein the secondary component comprises water, NGLs, or a combination thereof.

6. The method of claim 5, wherein the secondary component further comprises a compound selected from a group consisting of nitrogen, argon, hydrogen sulfide, mercaptans, hydrogen, and combinations thereof.

7. The method of claim 5, wherein the secondary component comprises water and NGLs, the method further comprising separating the NGLs and the water in a liquid-liquid separator, wherein the liquid-liquid separator comprises a decanter, a settling tank, or a combination thereof.

8. The method of claim 5, wherein the NGLs comprise compounds selected from the group consisting of ethane, propane, butane, isobutane, pentane, natural gasoline, cyclic hydrocarbons, aromatic hydrocarbons, or combinations thereof.

9. The method of claim 1, wherein one or more of the first vessel and the second vessel is a direct-contact exchanger, providing cooling through contact with one or more of a first contact liquid stream and a second contact liquid stream.

10. The method of claim 9, wherein one or more of the first contact liquid stream and the second contact liquid stream comprise a mixture of a solvent and an ionic compound, the solvent selected from the group consisting of water, hydrocarbons, liquid ammonia, liquid carbon dioxide, cryogenic liquids and combinations thereof, and the ionic compound selected from the group consisting of potassium carbonate, potassium formate, potassium acetate, calcium magnesium acetate, magnesium chloride, sodium chloride, lithium chloride, calcium chloride and combinations thereof.

11. The method of claim 9, wherein one or more of the first contact liquid stream and the second contact liquid stream comprise a mixture of a solvent and a soluble organic compound, the solvent selected from the group consisting of water, hydrocarbons, liquid ammonia, liquid carbon dioxide, cryogenic liquids, or a combination thereof, and the soluble organic compound selected from the group consisting of glycerol, ammonia, propylene glycol, ethylene glycol, ethanol, methanol, or a combination thereof.

12. The method of claim 9, wherein one or more of the first contact liquid stream and the second contact liquid stream are selected from the group consisting of ethers, alcohols, hydrocarbons, liquid ammonia, liquid carbon dioxide, cryogenic liquids, and combinations thereof.

13. The method of claim 12, wherein the alcohols are selected from the group consisting of methanol, ethanol, n-propanol, isopropanol, n-butanol, isobutanol, and combinations thereof.

14. The method of claim 9, further comprising separating the first contact liquid stream from the primary stream.

15. The method of claim 1, wherein one or more of the first vessel and the second vessel is an indirect-contact exchanger.

16. The method of claim 1, wherein the second vessel is an indirect-contact exchanger and further comprising:

adding the portion of the liquid methane stream to the second vessel;

indirectly cooling the portion of the liquid methane stream in the indirect-contact exchanger, resulting in a chilled liquid methane stream; and cooling the second depleted gas stream by direct contact with the chilled liquid methane stream.

17. A method for separating components of a gas comprising:

cooling a feed gas stream in a first vessel, wherein the feed gas stream comprises methane, carbon dioxide, and a secondary component, such that a first portion of the secondary component condenses, desublimates, or a combination thereof to form a primary stream, resulting in a first depleted gas stream leaving the first vessel;

cooling the first depleted gas stream in a condensing exchanger such that a first portion of the methane condenses as a first liquid methane stream, resulting in a second depleted gas stream leaving the condensing exchanger;

cooling the second depleted gas stream in the second vessel such that a first portion of the carbon dioxide desublimates, producing a solid product stream and resulting in a third depleted gas stream leaving the second vessel;

wherein cooling the feed gas stream in the first vessel condenses a second portion of the carbon dioxide into the primary liquid stream; and further comprising separating the carbon dioxide from the primary liquid stream.

18. A method for separating components of a gas comprising:

cooling a feed gas stream in a first vessel, wherein the feed gas stream comprises methane, carbon dioxide, and a secondary component, such that a first portion of the secondary component condenses, desublimates, or a combination thereof to form a primary stream, resulting in a first depleted gas stream leaving the first vessel;

cooling the first depleted gas stream in a condensing exchanger such that a first portion of the methane condenses as a first liquid methane stream, resulting in a second depleted gas stream leaving the condensing exchanger;

cooling the second depleted gas stream in the second vessel such that a first portion of the carbon dioxide desublimates, producing a solid product stream and resulting in a third depleted gas stream leaving the second vessel;

wherein the secondary component comprises water, NGLs, or a combination thereof;

wherein the secondary component further comprises a compound selected from a group consisting of nitrogen, argon, hydrogen sulfide, mercaptans, hydrogen, and combinations thereof; and wherein the secondary component comprises water and NGLs, the method further comprising separating the NGLs and the water in a liquid-liquid separator, wherein the liquid-liquid separator comprises a decanter, a settling tank, or a combination thereof.

* * * * *